US009970225B2

(12) United States Patent
Wynder

(10) Patent No.: US 9,970,225 B2
(45) Date of Patent: May 15, 2018

(54) FRAME WITH A SLIDING MECHANISM

(71) Applicant: Luke Wynder, Milton Keynes (GB)

(72) Inventor: Luke Wynder, Milton Keynes (GB)

( * ) Notice: Subject to any disclaimer, the term of this patent is extended or adjusted under 35 U.S.C. 154(b) by 13 days.

(21) Appl. No.: 15/022,652

(22) PCT Filed: Sep. 17, 2014

(86) PCT No.: PCT/GB2014/052829

§ 371 (c)(1),
(2) Date: Mar. 17, 2016

(87) PCT Pub. No.: WO2015/040395

PCT Pub. Date: Mar. 26, 2015

(65) Prior Publication Data

US 2016/0222709 A1 Aug. 4, 2016

(30) Foreign Application Priority Data

Sep. 17, 2013 (GB) ..... 1316528.7

(51) Int. Cl.
*E05F 11/34* (2006.01)
*E05D 15/16* (2006.01)
(Continued)

(52) U.S. Cl.
CPC ..... *E05D 15/165* (2013.01); *E05D 15/16* (2013.01); *E05D 15/22* (2013.01); *E06B 3/5063* (2013.01);
(Continued)

(58) Field of Classification Search
CPC ..... E05D 15/165; E06B 3/5063; E05Y 2201/654; E05Y 2900/148
(Continued)

(56) References Cited

U.S. PATENT DOCUMENTS 839,056 A * 12/1906 Black ..... E06B 3/50 49/179
853,765 A * 5/1907 Buck ..... E05B 77/48 318/246
(Continued)

FOREIGN PATENT DOCUMENTS

CA 1071683 2/1980
GB 186712 10/1922
(Continued)

OTHER PUBLICATIONS

Blum "MOVENTO Runner System. The Evolution of Motion", Blum GmbH, Product Catalog, ID No. 660.220.0, EP-184/1 EN-AL/09.11-1, P.1-24, Sep. 2011.
(Continued)

*Primary Examiner* — Jerry E Redman

(57) ABSTRACT

A window frame comprising a plurality of elongate frame members defining a frame opening for receiving a window for closing the frame opening. At least one of the elongate frame members having a longitudinally extending recess; and a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is arranged to be coupled to the window when the window is received within the frame opening to enable the window to slide relative to the frame.

19 Claims, 9 Drawing Sheets

(51) Int. Cl.
*E05D 15/22* (2006.01)
*E06B 3/50* (2006.01)
*E05D 13/00* (2006.01)

(52) U.S. Cl.
CPC ..... *E05D 13/12* (2013.01); *E05Y 2201/478* (2013.01); *E05Y 2201/654* (2013.01); *E05Y 2201/716* (2013.01); *E05Y 2201/722* (2013.01); *E05Y 2900/148* (2013.01)

(58) Field of Classification Search
USPC ..... 49/362; 160/197, 202, 222
See application file for complete search history.

(56) References Cited

U.S. PATENT DOCUMENTS 1,418,550 A 6/1922 Fentress
1,480,453 A * 1/1924 Lane ..... E05D 13/06 49/119
1,528,131 A * 3/1925 Price ..... E05D 13/06 49/362
1,647,901 A * 11/1927 Carver ..... E05F 11/42 49/362
1,683,914 A * 9/1928 Pfiffer ..... E05F 11/42 49/136
1,757,751 A 5/1930 Strauss
1,980,275 A * 11/1934 Julin ..... E06B 3/50 49/155
2,053,479 A 9/1936 Huttger
2,126,177 A * 8/1938 Dennis ..... E06B 3/50 49/150
2,538,329 A * 1/1951 Roos ..... E05F 11/423 49/119
2,720,393 A * 10/1955 Valeutine ..... E05D 13/06 292/80
3,237,250 A * 3/1966 Scoville ..... E05F 11/53 49/136
3,324,594 A * 6/1967 Hettinger ..... E05F 15/665 49/28
4,252,382 A 2/1981 Thomas
5,301,734 A * 4/1994 Opel ..... E05D 15/22 160/100
5,537,780 A * 7/1996 Cleaver ..... E06B 7/086 49/82.1
5,605,013 A * 2/1997 Hogston ..... E05F 15/673 49/31
6,119,402 A * 9/2000 Wisner ..... E05F 11/535 49/118
6,343,436 B1 * 2/2002 Milano, Jr. ..... E05F 15/67 49/139
6,631,586 B1 * 10/2003 Nakagomi ..... E05D 13/12 49/349
6,701,669 B1 * 3/2004 Yorgason ..... E06B 7/096 49/82.1
6,708,448 B2 * 3/2004 Zappa ..... E05F 15/635 49/118
7,111,430 B2 * 9/2006 Kinsey ..... E05D 15/22 49/187
8,166,705 B2 * 5/2012 Iimori ..... E05F 15/689 49/349
8,595,977 B2 * 12/2013 Hancock ..... E05F 15/635 49/25
9,003,708 B2 * 4/2015 Shiroma ..... F16H 19/04 49/362
9,382,745 B2 * 7/2016 Plummer ..... E05F 15/603
2001/0027621 A1 * 10/2001 Davies ..... G09F 23/06 49/360
2004/0244295 A1 * 12/2004 Derham ..... E05F 15/665 49/362
2005/0257429 A1 * 11/2005 Yorgason ..... E06B 7/096 49/82.1
2008/0211365 A1 9/2008 Moll
2009/0195131 A1 8/2009 Chi et al.
2016/0032642 A1 * 2/2016 Rotchell ..... E06B 7/086 49/82.1

FOREIGN PATENT DOCUMENTS

GB 396283 8/1933
GB 2022992 12/1979
JP 2006-233711 9/2006
WO WO 2015/040395 3/2015

OTHER PUBLICATIONS

International Search Report and the Written Opinion dated Dec. 11, 2016 From the International Searching Authority Re. Application No. PCT/GB2014/052829.

* cited by examiner

FRAME WITH A SLIDING MECHANISM

RELATED APPLICATIONS

This application is a National Phase of PCT Patent Application No. PCT/GB2014/052829 having International filing date of Sep. 17, 2014, which claims the benefit of priority of United Kingdom Patent Application No. 1316528.7 filed on Sep. 17, 2013. The contents of the above applications are all incorporated by reference as if fully set forth herein in their entirety.

FIELD AND BACKGROUND OF THE INVENTION

The invention relates to closure elements such as doors and windows, and to frames for such closure elements, and more particularly to a frame with a sliding mechanism for enabling a closure element within the frame to slide relative to the frame.

The frame may be a window frame for receiving one or more sashes of a sash window assembly, at least one of which can be slid relative to the frame using the sliding mechanism.

Sash window assemblies may comprise a counter balance system to enable the sash to be easily moved relative to the frame. The counter balance reduces the force required to lift the sash with the counter balance connect to the sash via a pulley. When the sash is raised the counter balance drops, such that part of the force required to lift the sash is provided by the counter balance. Similarly when the sash is lowered, an additional force will be required to overcome the weight of the counter balance, thus inhibiting the sash from moving relative to the frame simply under the weight of the sash.

Alternatively a spiral balance system may be used in which a spiral rod with a thread of varying pitch is coupled to a sash. The spiral rod is coupled to a spring, such that when the spiral rod is rotated the spring is compressed, therefore providing a counter force against the weight of the sash during lifting or lowering of the sash.

The spiral balance system may employ an extension spring. The force from the extension spring may not be constant, for example the force to move an extended spring can vary from the force required to extend a compressed spring. The variation in force can lead to an insufficient force from the spring at the extremities of travel of the sash, therefore leading to the sash moving relative to the frame at the top and bottom due to the weight of the sash or force of the spring. The variation of the pitch on the spiral rod leads to a change in the compression of the spring, such that the variation in the force during compression of the spring is accounted for.

The length of travel of the sash for which the weight of the sash window is equal to the force from the spiral spring system is limited, therefore the spiral spring system requires travel stops to prevent overextension of the spring and permanent damage to the spring. Without the use of travel stops, the behaviour of the spring will change due to a deformation of the spring and thus the function of the window assembly will subsequently change.

A window assembly may enable a sash to be rotated out of the plane of the window frame, for example to enable cleaning. An expanding shoe within a track may be used to inhibit the sash from moving in the plane of the frame whilst rotated out of the plane of the frame. The expanded shoe inhibits the movement of the sash by friction with the frictional force increasing as the sash is rotated further. The frictional force may not be sufficient when the sash is partially rotated out of the plane of the frame, leading to slippage of the sash in the plane of the frame and possible misorientation such that one side of the sash drops relative to the other. It can be difficult to rectify the position of the sash to the original aligned or "square" position. If the sash is moved whilst in the misoriented state the sash may rub against the window frame causing damage of the outer edge of the frame and/or sash.

A sash window may use metal arms to arrest the rotation of the sash relative to the frame. Metal arms can lead to additional wear on the frame and/or sash during rotation of the window. Moreover if the sash and the window become misorientated the contact between the metal arms and the frame and/or sash will increase and therefore the rate of wear will increase. The additional wear can remove any protective coating (e.g. paint), this can be unsightly and reduce the protection of the underlying material.

SUMMARY OF THE INVENTION

An embodiment of the disclosure provides a frame comprising a plurality of elongate frame members defining a frame opening for receiving a closure element for closing the frame opening with at least one of the elongate frame members having a longitudinally extending recess. A slide mechanism is received within the recess, wherein the slide mechanism comprises a first track fixed within the recess and a second track movable within and along the recess and coupled to the first track via a rotary coupling member. The movement of second track along the recess causes the rotary coupling member to rotate. The second track is arranged to be coupled to the closure element when the closure element is received within the frame opening to enable the closure element to slide relative to the frame.

In one example the frame is a window frame and the closure element is a window, such as a sash.

The second track can be coupled to the closure element by at least one connecting member defining a pivot about which the closure element can rotate relative to the frame. The frame can also comprise a cord attachable to the closure element to enable the rotation of the closure element about the pivot to be arrested. The cord can further comprise a cord reel, the cord being arranged to be extended or retracted by the cord reel as the closure element moves about the pivot point.

The frame may also comprise one or more bolts, for example to hold the window in a given position and/or connectable to the closure element to inhibit rotation of the closure element about the pivot. The bolt or bolts may be a shoot bolt mechanism.

A bolt can be arranged to activate a locking mechanism to inhibit movement of the second track relative to the first track. The locking mechanism may comprise a spring biased to a locked condition, and the bolt may be arranged to hold the locking mechanism in an unlocked condition against the biasing of the spring bias when the bolt is disengaged to enable rotation of the closure element about the pivot. The locking mechanism, when in the locked condition, inhibits movement of the second track relative to the first track.

The rotary coupling member of the frame can comprise a first rotary coupling element coupled with the first track and a second rotary coupling element coupled with the second track. The first rotary coupling element may be a different diameter to the second rotary coupling element such that upon rotation of the rotary coupling member the second rotary coupling element moves a different distance along the second track than the first coupling element moves along the first track.

The first and second tracks may be racks comprising a plurality of teeth. The rotary coupling member may be a pinion comprising a plurality of teeth. The rotary coupling member may comprise a first toothed pinion coupled with the first track and a second toothed pinion coupled with the second track. The first and second pinions can have different numbers teeth such that upon rotation of the rotary coupling member the second pinion moves a different distance along the second track than the first pinion moves along the first track.

Where provided, the locking mechanism may comprise teeth which lock with at least one of the second rack and the rotary coupling member when in the locked position.

The first or second tracks can comprise a freewheeling area in which the rotary coupling member is not engaged with the tracks.

The frame may comprise a spring coupled to the second track and the frame wherein the spring is arranged to modulate the force required to move the second track relative to the first track. The spring can be a gas spring. In one embodiment, the gas spring can be pressurised to a pressure to adjust the resistance to motion of the second track.

In an embodiment, the one or more closure elements may be able to slide relative to the frame, each being movable independently of the other. In an embodiment, the one or more closure elements can also move by rotating out of the plane of the frame about a pivot.

BRIEF DESCRIPTION OF THE SEVERAL VIEWS OF THE DRAWINGS

Aspects of the disclosure are also described in detail, by way of example only, with reference to the accompanying drawings, in which.

In the drawings like reference numerals are used to indicate like elements.

DESCRIPTION OF SPECIFIC EMBODIMENTS OF THE INVENTION

Figure 1A:
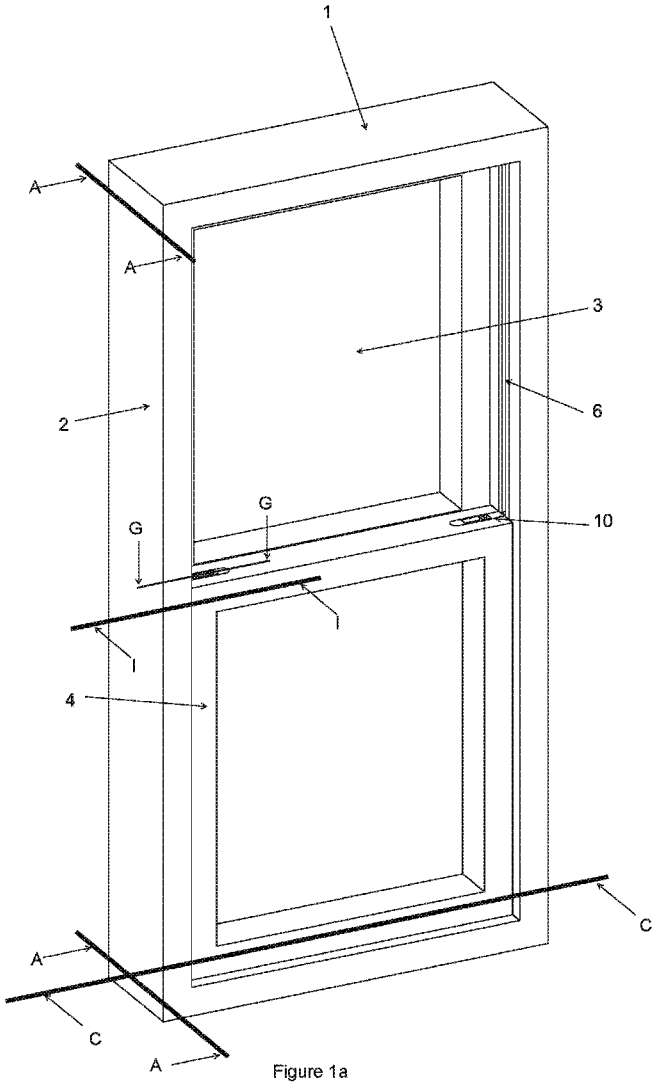
FIG. 1*a* shows a perspective view of a window assembly with a window coupled to a frame.
Figure 1B:
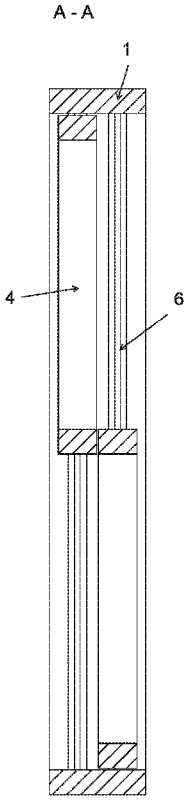
FIG. 1*b* shows a cross sectional view of the window assembly of FIG. 1*a;*

FIG. 1 and FIG. 2 show an example of a frame 1 comprising a plurality of elongate frame members or jambs 2 (in the example shown four) defining a frame opening 3, in this example a rectangular or square frame opening, for receiving a closure element 4 for closing the frame opening. At least one of the elongate frame members has a longitudinally extending recess 6. A slide mechanism 7 is received within the recess 6. As shown in FIGS. 3*a*, 3*b*, 4*a*, 4*b*, 4*c*, 5*a* and 5*b*, the slide mechanism comprises a first track 12 fixed within the recess 6 and a second track 14 movable within and along the recess 6 and coupled to the first track via a rotary coupling member 16. Movement of second track 14 along the recess 6 causes the rotary coupling member 16 to rotate. The second track 14 is arranged to be coupled to the closure element 4 by at least one connecting member 8 so that the sliding mechanism enables the closure element 4 to be slid relative to the frame 2.

The window assembly may have one or more sliding mechanisms. In the example shown in FIGS. 1 and 2 the window assembly comprises two sliding mechanisms 7, located within respective recesses 6 of opposed first and second jambs 2 of the frame. Each sliding mechanism 7 is coupled to the window by at least one connecting member 8. FIGS. 1 and 2 show two windows with each window coupled to two sliding mechanisms 7, to enable each window to slide independently with respect to the frame.

Figure 3A:
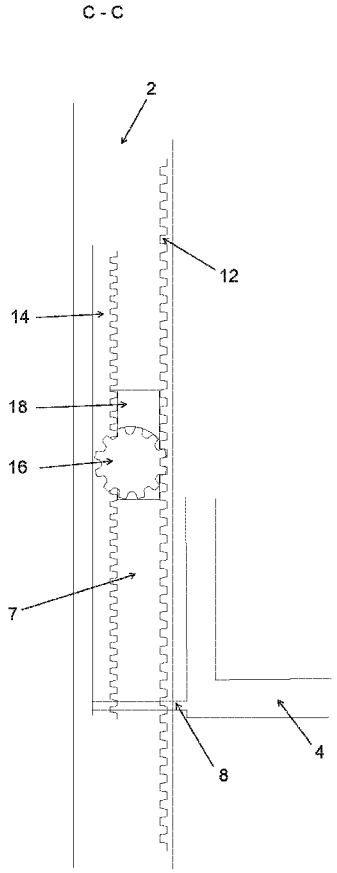
FIG. 3*a* shows a schematic cross-sectional view of part a frame member or jamb of the window assembly to illustrate a sliding mechanism within a recess of the frame member.
Figure 3B:
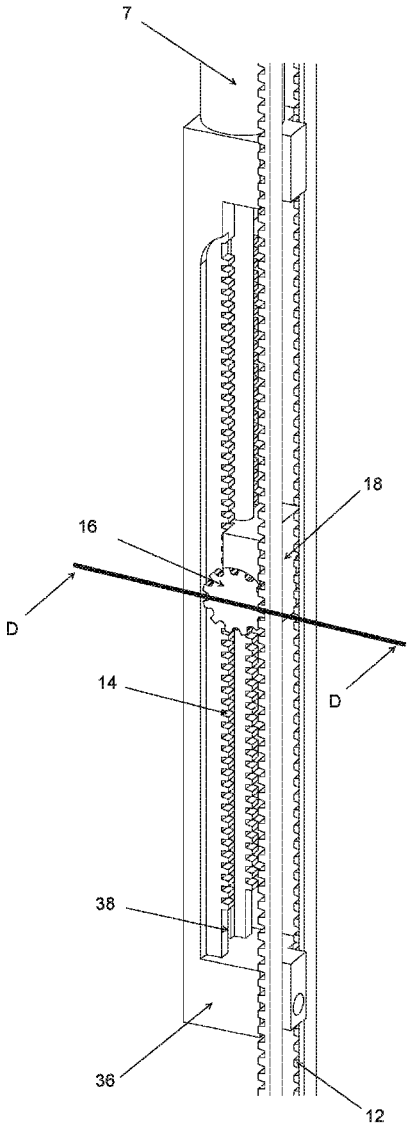
FIG. 3*b* shows a perspective view of part of the window assembly to illustrate the sliding mechanism shown in FIG. 3*a;*

FIG. 3*a* shows a sliding mechanism 7 located within a recess 6 of a jamb 2 of the window frame 1. In this example the first and second tracks 12 and 14 are racks comprising a plurality of teeth and the rotary coupling member 16 is a pinion comprising a plurality of teeth and the rotary coupling member is located on a slide block 18 slidable along the jamb in the direction of the recess.

The second track 14 is coupled to the closure element 4 via a connecting member 8, such that the relative movement of the second track to the first track moves the closure element relative to the frame member 2 of the window frame 1.

Figure 5A:
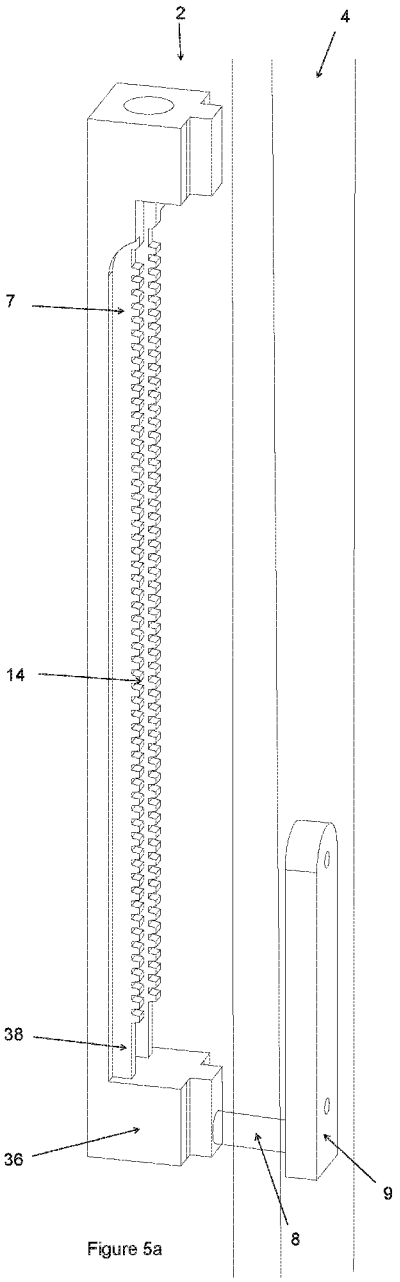
FIG. 5*a* shows a perspective view of part of the sliding mechanism connected to an attachment device to attach the slide mechanism to a window.
Figure 5B:
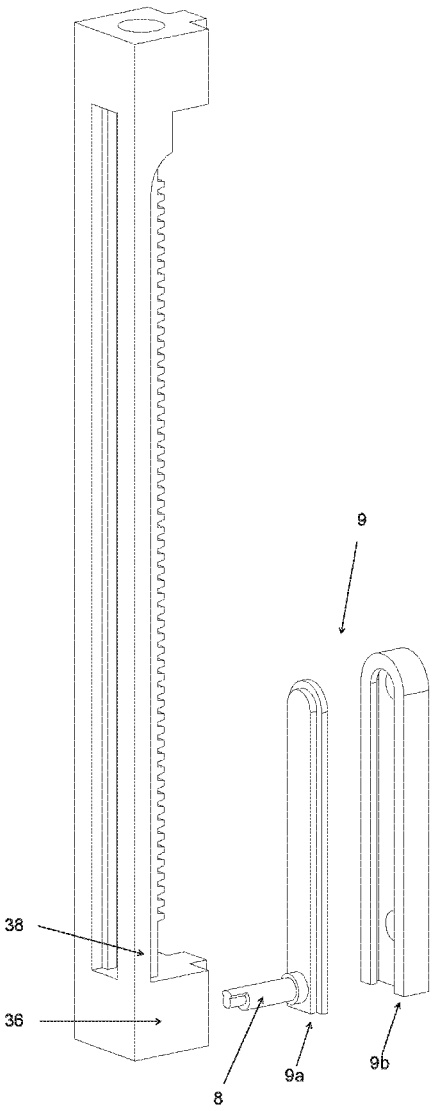
FIG. 5*b* shows an exploded view of the attachment device of FIG. 5*b;*

In the specific example shown in FIGS. 5*a* and 5*b* the connecting member 8 couples the closure element 4 via an attachment device 9 to the second track 14. In this example, the connecting member 8 and attachment device 9 forms a pivot about which the window can rotate out of the plane of the window relative to the frame member 2. The attachment device, as shown in FIG. 5*b*, has a section 9*a* attached to the connecting member 8. The section 9*a* can be coupled to a section 9*b* received by the window. In this example the section 9*b* is embedded within a frame of the window, and attachable to section 9*a* to couple the window to the frame member 2 via the connecting member 8. As another possibility, the window can be connected to the window frame at multiple positions on the track. In an embodiment where the window is coupled to the second track at plural locations the window may not be able rotate out of the plane of the window frame, unless all but one connection to a frame member 2 can be released or retracted.

Figure 4A:
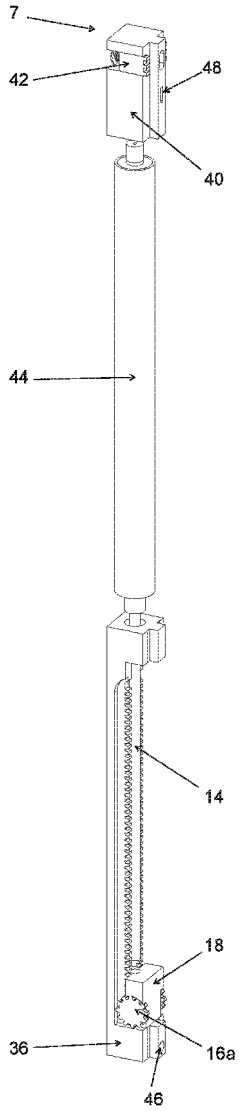
FIG. 4*a* shows a perspective view of part of the sliding mechanism of FIGS. 3*a* and 3*b* connected to a gas spring.
Figure 4B:
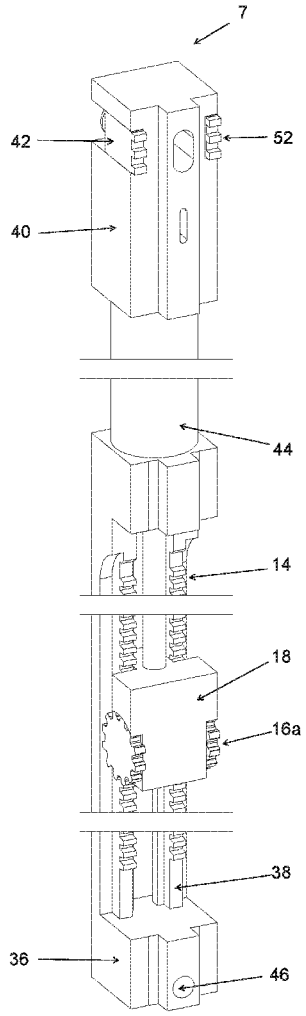
FIG. 4*b* shows a perspective view, part broken away, of part of the sliding mechanism and gas spring of FIG. 4*a;*
Figure 4C:
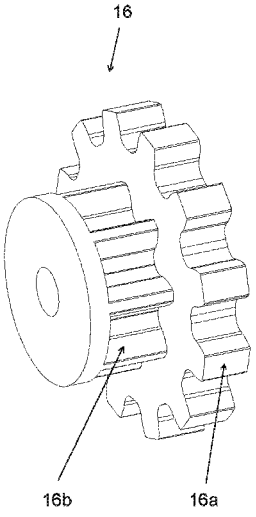
FIG. 4*c* shows a rotary coupling member.

In the examples shown in FIGS. 3*b*, 4*a*, 4*b*, 4*c*, 5*a* and 5*b* the sliding mechanism comprises a pair of first tracks 12 and second tracks 14 with two rotary coupling members coupling each first track to a respective second track. The rotary coupling member may, as shown in FIG. 4*c*, comprise first and second rotary coupling elements 16*a* and 16*b* of different diameters to enable gearing of the movement of the first and second tracks. For example the first rotary coupling element 16*a* may be a smaller diameter than the second rotary coupling element 16*b* and the first rotary coupling element 16*a* may be connected to the first track and the second rotary coupling element 16*b* to the second track. Such gearing enables the second track 14 to move a greater distance than the first rotary coupling element moves along the first track. As another possibility the rotary coupling member may have a single rotary coupling element and therefore comprise a single diameter rotary coupling with no gearing.

Figure 6A:
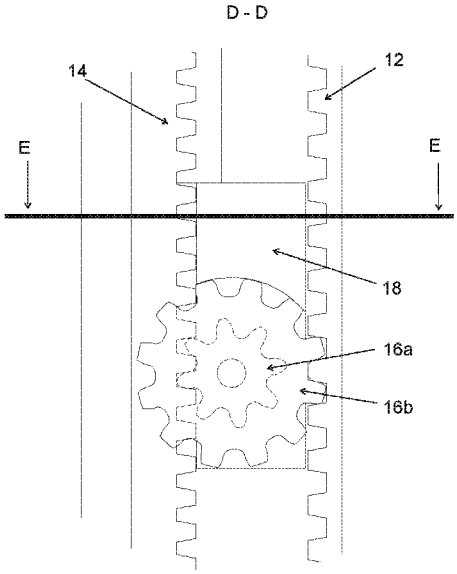
FIG. 6*a* shows a schematic cross sectional view illustrating the engagement of the rotary coupling member with the first and second tracks.

In the example shown in FIG. 4*c* the rotary coupling member is one of a pair of rotary coupling members, shown in a coupling position in FIGS. 4*b* and 6*a*. The pair of rotary coupling members may be coupled using an axle supported by the slide block 18, to ensure the rotary coupling members rotate at the same frequency. FIGS. 4*b* and 6*a* show the first rotary coupling member 16*a* coupled to the first track 12 (not shown) and the second rotary coupling member 16*b* coupled to the second track 14.

Figure 6B:
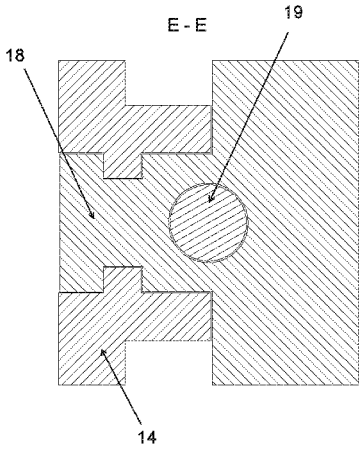
FIG. 6*b* shows a cross sectional view of a slide block coupled to the track.

As shown in FIG. 6*b*, the slide block 18 is locked with the second track 14 and has a hole 19 in which a gas spring, described in more detail below, can be located and coupled with the slide block 18. In the example shown in FIG. 6*b* the slide block 18 is coupled to a pair of second tracks 14 and moves along the channels provided by the pair of the second tracks.

As mentioned above, the window can be rotated about the connecting member(s) 8 out of the plane of the frame. In the example shown in FIGS. 2*a* and 2*b* the closure element 4 comprises at least one bolt, for example a shoot bolt, 10 spaced along the frame member from the connecting member(s) to couple the closure element and the frame member so as to inhibit rotation of the closure element about the connecting member(s) 8. In the example, shown there are two bolts 10, one associated with each connection member 8.

Figure 7A:
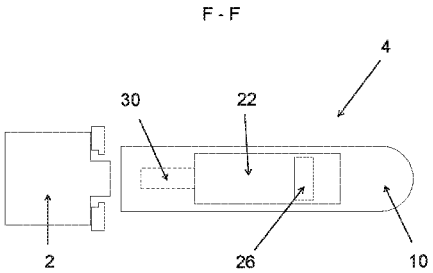
FIG. 7*a* shows a shoot bolt in an open position.
Figure 7B:
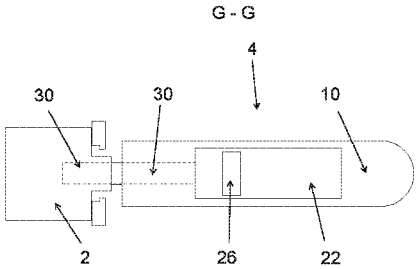
FIG. 7*b* shows the shoot bolt in a closed position.

An example of a shoot bolt 10 is shown in FIGS. 7*a* and 7*b* with FIG. 7*a* showing the shoot bolt in a released position in which the closure element can rotate relative to the frame and FIG. 7*b* showing the shoot bolt in an engaged position in which the closure element cannot rotate relative to the frame. In this example the shoot bolt is located on the closure element 4 and extends from the window into the window frame in the engaged position of the bolt. In another example the shoot bolt may be located on the frame with the bolt extending from the window frame into the window in the engaged position.

Each shoot bolt 10 is received in a recess in the window and comprises a sliding member 26 able to slide within a channel 22. The sliding member 26 is coupled to a bolt 30 (not shown in FIG. 4*a*) that can be gripped by a user during operation to engage or disengage the shoot bolt. The sliding member 26 is held in the engaged position by a raised member (not shown) within the shoot bolt. The raised member can be lowered to enable the sliding member 26 to move from the engaged position. As described below when the shoot bolt is disengaged, a locking mechanism 42, coupled to the second track, is activated to engage a locking member 52 with the first (fixed) track to inhibit the movement of the second track relative to the first track.

Figure 9A:
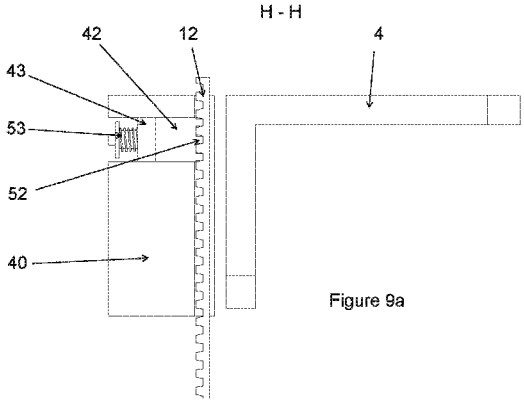
FIG. 9*a* shows a locking device in a locked position.
Figure 9B:
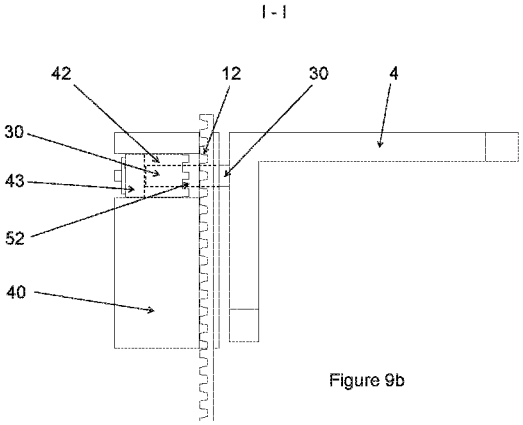
FIG. 9*b* shows a locking device in an unlocked position.
Figure 9C:
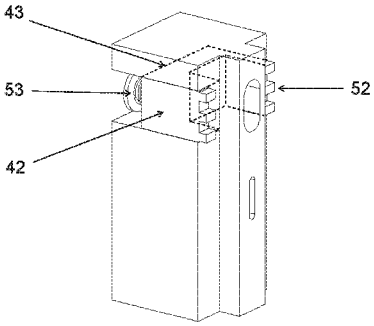
FIG. 9*c* shows a perspective view of the locking device.

FIGS. 9*a* and 9*b* show the locking mechanism 42 in a locked and unlocked position respectively. The locking mechanism in this example comprises a biasing spring 53 and a yoke 43 that carries the locking member 52 and cooperates with the shoot bolt 30. FIG. 9*c* shows an example yoke with arms defining a 'U' shape coupled to the locking member 52.

When the shoot bolt 30 is disengaged, allowing the closure element 4 to rotate about the connecting member 8 (as described above), the shoot bolt 30 is not in contact with the yoke 43. This means that the bias of the spring can move the locking member 52 into engagement with the first track, as shown in FIG. 9*a*, which, because the locking mechanism is coupled to the second track, inhibits movement of the first track relative to the second track. The closure element may also be referred to as a closure mechanism.

When the shoot bolt is engaged, inhibiting the closure element from rotating about the connecting member 8 shoot bolt (as described above), the shoot bolt 30 is in contact with the yoke 43. This means that the shoot bolt retains the spring in a compressed state so that the yoke 43 and thus the locking member 52 do not engage the first track, as shown in FIG. 9*b*, and so the first track is free to move relative to the second track.

The locking member may comprise one or more teeth that lock with teeth of the first track. In other examples the locking member may engage with first track by friction or another form of lock to a receiving point on the track.

The shoot bolt may also be located in an intermediate position so that the shoot bolt is engaged to inhibit the closure element from rotating about the connecting member 8 and the locking member 52 is engaged with the first track 12. In the intermediate position the shoot bolt is located in a position between the position illustrated in FIG. 9*a* and the position illustrated in FIG. 9*b*. The intermediate position corresponds to the shoot bolt being engaged to inhibit the closure element from rotating about the connecting member 8 without a force that is sufficient to compress the biasing spring 53 so that the locking member 52 does not engage with the first track. In other examples the bolt may be a lever that can be rotated about a pivot to engage and disengage the bolt. As it will be appreciated by a person skilled in the art the bolt may be activated by various mechanisms such as a shoot bolt, a lever bolt, or a key operated bolt.

The closure element may comprise a catch coupleable to two or more shoot bolts 30. In one example, the catch is coupleable to one or more shoot bolts via a rod, with the catch moving the rod relative to the closure element and the rod cooperating with the shoot bolt to activate the shoot bolt to inhibit the movement of the first track relative to the second track as described above.

In one example the catch may be operable to couple a first closure element to a second closure element to inhibit the movement of the first closure element relative to the second closure element. The catch may be positioned on one of the first closure element or the second closure element and is operable to move a bolt coupled to the one of the first closure element and second closure element to a bolt receiving portion coupled to the other of the first closure element and second closure element.

The catch may be operable to inhibit relative motion of two closure elements and/or activate the shoot bolt to inhibit movement of the first track 12 relative to the second track 14. For example the catch may have four settings, as described below.

In a first setting the first closure element is uncoupled from the second closure element and the first closure element is moveable relative to the second closure element. In the first setting the rod cooperates with the shoot bolt to activate the shoot bolt to retain the spring in a compressed state so that the yoke 43 and thus the locking member 52 do not engage the first track, as shown in FIG. 9*b*, and so the first track is free to move relative to the second track and the shoot bolt inhibits the closure element from rotating about the connecting member 8.

In a second setting the catch is activated to couple the first closure element to the second closure element to inhibit the movement of the first closure element relative to the second closure element. In the second setting the rod cooperates with the shoot bolt to activate the shoot bolt to retain the spring in a compressed state so that the yoke 43 and thus the locking member 52 does not engage the first track, as shown in FIG. 9*b*, and so the first track is free to move relative to the second track and the shoot bolt inhibits the closure element from rotating about the connecting member 8.

In a third setting the first closure element is uncoupled from the second closure element and the first closure element can therefore move relative to the second closure element. In the third setting the shoot bolt is in the intermediate position corresponding to the shoot bolt being engaged to inhibit the closure element from rotating about the connecting member 8 without a force that is sufficient to compress the biasing spring 53 so that the locking member 52 does not engage the first track In a fourth setting the first closure element is uncoupled from the second closure element and the first closure element can therefore move relative to the second closure element. In the fourth setting the shoot bolt is disengaged allowing the closure element to rotate about the connecting member 8 (as described above). The shoot bolt 30 is not in contact with the yoke 43, this means that the bias of the spring moves the locking member 52 into engagement with the first track, as shown in FIG. 9*a*, which, because the locking mechanism is coupled to the second track 14, inhibits movement of the first track relative to the second track 14.

Figure 2A:
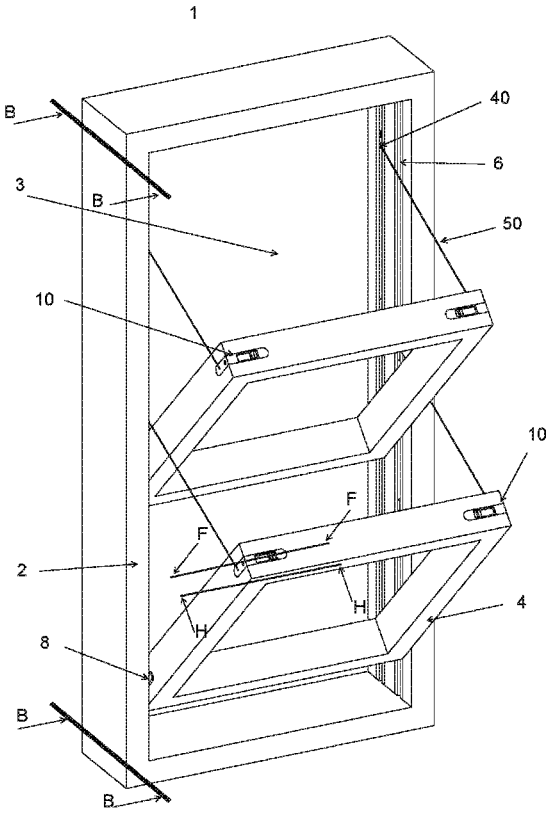
FIG. 2*a* shows a perspective view of a window assembly with two windows held in a rotated state relative to the frame with the rotation arrested by a cord.
Figure 2B:
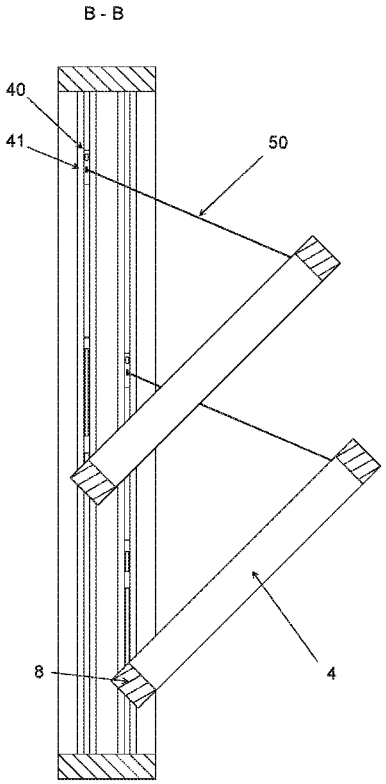
FIG. 2*b* shows a cross sectional view of the window assembly of FIG. 2*a;*

FIG. 2*b* shows the sliding mechanism and a retention mechanism for arresting the window when it is partially rotated. The retention mechanism is received within the recess 6 and coupled to the second (movable) track, therefore moving in synchrony with the window. The retention mechanism may comprise a cord reel located in the housing 40 in the recess 6. The cord is attachable to the window, passing through a hole 41 located on the cord housing 40. As the window rotates about the connecting member(s) 8 the cord extends from the cord reel. The cord arrests the rotation of the window when the cord is fully extended from the cord reel.

FIGS. 2*a* and 2*b* show an example with two sashes rotated relative to a frame with the rotation arrested by a cord. The two windows 4 are each rotated about a connecting member 8 with a cord 50 connected to the window and the frame via a cord reel located in the housing 40. The rotation of the window about the pivot 8 is arrested by the cord 50. In another example the cord may be slack when the window in the plane of the frame and become taut as the window is rotated out of the plane, so as to arrest the rotation of the window.

In another example, the rotation of the closure element about the pivot is arrested by metal arms, although as described above the use of metal arms may lead to additional wear.

Figure 8A:
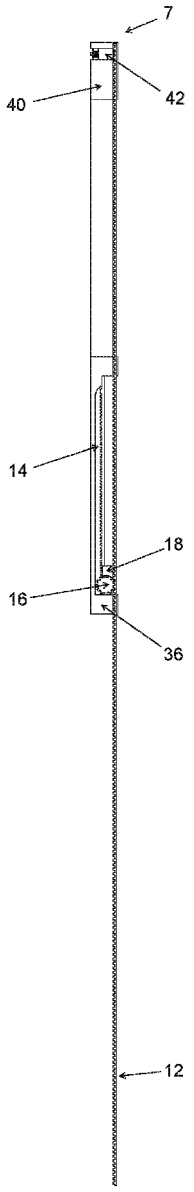
FIG. 8*a* shows the sliding mechanism in a first position.
Figure 8B:
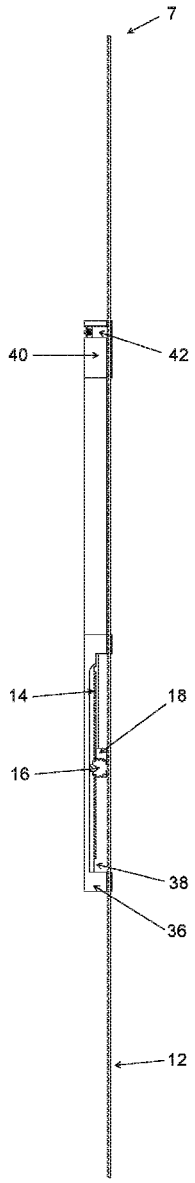
FIG. 8*b* shows the sliding mechanism in a second position.
Figure 8C:
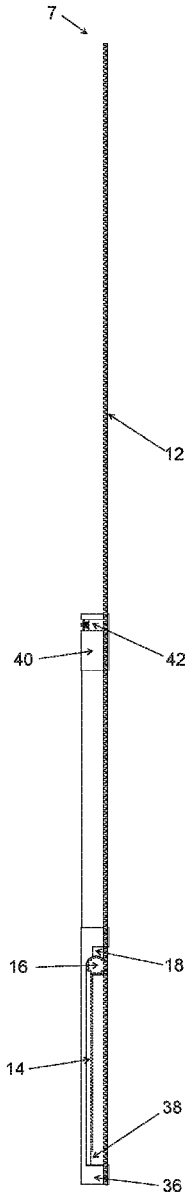
FIG. 8*c* shows the sliding mechanism in a third position.

FIGS. 8*a*, 8*b* and 8*c* show the sliding track mechanism located in the recess of the jamb (not shown) of the frame illustrating the sliding mechanism in a first, second and third position. The sliding mechanism has a freewheeling area 38 where the rotary coupling member is not coupled to the second track 14. In the example shown the freewheeling area 38 is a tooth free area located at the end of second track where the rotary coupling member is remains engaged with the first track 12 but is not engaged with the second track. Whilst the rotary coupling member is in the freewheeling area 38 the rotary coupling member is disengaged from the second track 14 but remains engaged with the first track 12 and therefore the first track 12 can be moved relative to the second track 14 and the relative positions of the first and second tracks can be changed enabling the sliding mechanism to be adjusted, for example as shown in FIG. 5*a*, during an installation process.

In this example the rotary coupling member is moved from the freewheeling area 38 by applying a force on the sliding mechanism 7 to engage the rotary coupling member 16 with the first and second tracks.

FIG. 8*b* shows the sliding mechanism in a second position, with the rotary coupling member 16 engaged with the first and second tracks. The slide block 18 has moved relative to the first position shown in FIG. 8*a*, therefore moving the second track 14 relative to the first track 12. FIG. 8*c* shows the rotary coupling member approaching the end of the travel limit, with the rotary coupling member 16 at the opposite end to the freewheeling area 38 of the second track 14.

FIGS. 4*a* and 4*b* shows an embodiment with a gas spring 44 attached to the sliding mechanism to counter the weight of the closure element, therefore preventing the window from sliding relative to the frame under the weight of the window. In the example shown, the gas spring is coupled to slide block 18 and the second track 14. The gas spring 44 is coupled to the slide block 18 with an interference fit, and is coupled to the slide block by locating an end of the piston of the gas spring in the hole 19 of the slide block as described above. The motion of the slide block 18 relative to the second track will move the piston of the gas spring relative to the body of the gas spring and therefore resist (during compression) or assist (during expansion) the motion of the second track 14 relative to the first track 12. In other examples, the slide block 18 may comprise, for example, a locking mechanism and/or a screw mechanism to couple the gas spring into the slide block.

In the example shown in FIGS. 4*a* and 4*b* the gas spring is coupled to the cord housing 40 using a screw mechanism, where the thread on the gas spring 44 is received by the cord housing 40. In other examples the gas spring may couple to the cord housing using, for example, a locking mechanism and/or an interference fit.

The slide block 18 is coupled to move with the closure element 4 relative to the frame 2 along the recess 6, and as the closure element moves the gas spring 44 is compressed or extended. The force required to compress or extend the gas spring counteracts the weight of the window. The gas spring can be pressurised to different pressures to vary the resistance to compression and expansion, therefore enabling the resistance to be varied according to the weight of the closure element. The pressure of the gas spring may be adjusted using an adjustment mechanism on the gas spring, for example, the gas spring may comprise a valve to allow the pressure in the gas spring to be lowered according to the weight of the closure element. The gas spring may also have a mechanism to allow the pressure in the gas spring to be increased, for example, the valve of the gas spring may be coupleable to a pump to increase the pressure of the gas in the gas spring.

In one example the gas spring comprises a collar to adjust the friction between the piston of the gas spring and the body of the gas spring. The frictional force between the piston of the gas spring and the body of the gas spring provides a resistive force against the motion of the spring rod relative to the body of the gas spring, therefore the biasing force provided by the gas spring to counteract the weight of the window may be varied by adjusting the friction between the piston of the gas spring and the body of the gas spring.

Figure 10A:
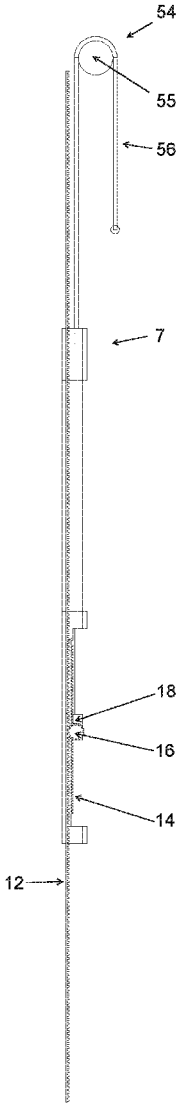
FIG. 10*a* shows a sliding mechanism coupled to a closure element via a pulley system.
Figure 10B:
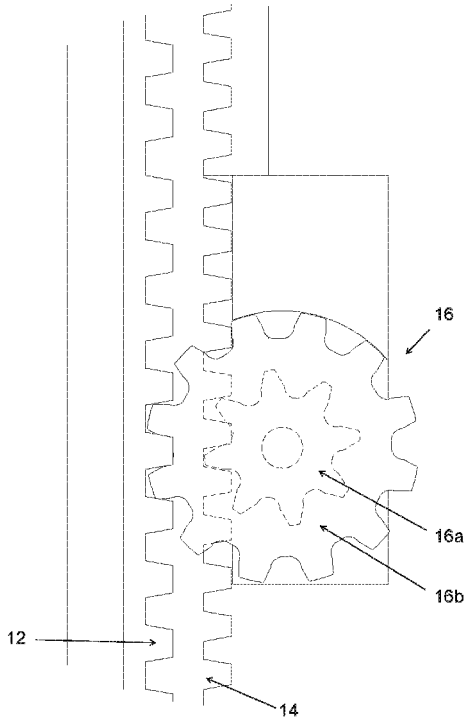
FIG. 10*b* shows a schematic cross sectional view illustrating the engagement of the rotary coupling member with the first and second tracks of the sliding mechanism of FIG. 10*a*.

FIGS. 10*a* and 10*b* show an embodiment with the second track 14 coupled to the closure element 4 via one or more pulley systems 54 instead of the connecting member(s) 8. The pulley system 54 comprises a pulley 55 and a cord 56. The cord 56 has a first and second end, with the first end coupled to the closure element 4 and the second end coupled to sliding mechanism 7. In this embodiment the rotary coupling member 16 moves along the first track 12 (fixed within the recess 6) and is coupled to the second track 14 (movable within and along the recess 6) such that during operation the rotary coupling member 16 and the second track 14 move in opposite directions relative to the first track 12. The motion of the second track 14 is opposed to the motion of the closure element 4 due to the closure element 4 being coupled to the second track 14 via the pulley 55. Coupling the closure element 4 to the second track via one or more pulley system(s) 54 may assist retro-fitting of the slide mechanism 7 with existing pulley and counter weight systems. In the example described above a gas spring is used to counter the weight of the closure element, in other examples a wire spring and/or an elastic mechanism may be used to counteract the weight of the window.

In an example the range of motion of the closure element relative to the frame is limited by one or more travel stops. For example, the frame may comprise a mechanism to inhibit movement of the first track 12 relative to the second track 14 when the second track 14 is moved relative to the first track 12 beyond a threshold point. In this example the travel stop may comprise a section coupleable to the frame and the movement of the second track 14 relative to the first track 12 is inhibited by the second track 14 coupling to the travel stop.

The threshold point can be altered by adjusting the position of the travel stop, for example by decoupling the section from the frame and moving the section to a different position of the frame to alter the range of motion of the second track 14 is relative to the first track 12, and therefore the closure element 4 relative to the frame. In one example the section is coupleable to the frame with an interference fit, in another example the section is coupleable to the frame with a screw coupling. The position of the travel stop can be adjusted, for example, by decoupling the section from the frame and moving the section to a different position of the frame to alter the range of motion of the closure element 4 relative to the frame.

In an example the travel stop may comprise a section coupleable to the first track 12 and/or the second track 14.

The rate of motion of the closure element 4 relative to the frame can be limited using an inertia lock. The inertia lock is activated by the closure element accelerating above a set value, for example, after a failure of the spring mechanism the closure element would accelerate due to gravity and the inertia lock would be activated to reduce the acceleration or reverse the acceleration of closure element. In an example, once activated the inertia lock couples to the track to transfer a force to the closure element reducing or reversing the acceleration of the closure element.

In one example, the inertia lock is coupled to the second track 14 via a pivot. The inertia lock rotates about the pivot and couples to the first track 12 to reduce the acceleration or reverse the acceleration of closure element coupled to the second track via the connecting member 8. The acceleration of the closure element, and therefore the second track 14, rotates the inertia lock about the pivot. If the acceleration of the closure element is greater than a threshold value the acceleration will provide sufficient torque to rotate the inertia lock about the pivot and couple the inertia lock to the first track 12. The inertia lock may couple to the track such that the friction between the inertia lock and track reduces the acceleration or reverses the acceleration of the closure element 4. In an example the second track 14 is a rack comprising a plurality of teeth and the inertia lock comprises a tooth or a plurality of teeth that couple to the teeth of the second rack.

In an example the resistance force provided by the gas spring is variable with the extension of the gas spring. For example, the resistance force of the gas spring may be increased based on the range of travel of the first track 12 relative to the second track 14, with the resistance force increased at an extension of the gas spring corresponding to the movement of the second track 14 relative to the first track 12 approaching the limit of the range of travel such that the motion of the closure element is slows as the closure element approaches the limit of the range of travel.

In an example the weight of the closure element may be adjusted by adding weights to the closure element to according to the resistance force provided by the spring.

In an example the second track 14 comprise one or more rotary coupling members coupling the second track 14 to the frame member 2. In one example the second track 14 comprises three rotary coupling members coupled to the second track 14 and the frame member 2 on three sides of the second track. The one or more rotary coupling members reduces friction between the second track 14 and the frame member 2 to enable a smooth movement of the second track 14 relative to the frame member 2.

In an example the first track 12 may be coupled to the second track 14 via two or more rotary coupling members, for example the slide block 18 may comprise two or more rotary coupling members. The two or more rotary coupling members may be located adjacent to one another, for example, with one rotary coupling member coupled to the track at a different point of the track to the other rotary coupling member. The two or more rotary coupling members may be positioned coaxially, with one rotary coupling member coupled to the track at the same point of the track to the other rotary coupling member.

In an example the first track comprises a track portion and a rack portion and the second track comprises a track portion and a rack portion with a rotary coupling member comprising a rotary coupling element coupled to the track portion of the first track and the track portion of the second track, and a pinion coupled to the rack portion of the first track and the rack portion of the second track.

In an example the length of the track may be adjusted according to the size of the frame. For example, the track may be reduced in length by snapping or cutting the track to the length required. In an example the track may be modular, with the track comprising a coupling mechanism to allow sections of the track to be coupled to increase the length of the track. The modular sections of the track may be coupled via an interference coupling, or a screw coupling.

In the examples described above the sliding mechanism the tracks are racks comprising a plurality of teeth, in other examples the racks may be tracks without teeth.

In examples described above the sliding mechanism may comprise a first track and a second track with the first track coupled to the second track via a rotary coupling member. In an example the tracks may be racks comprising a plurality of teeth and the rotary coupling member is a pinion comprising a plurality of teeth.

Although the examples described relate to a closure element being a sash and a frame a window frame, other examples of a closure element can include sliding doors able to slide relative to a door frame, drawers with a sliding mechanism to open and close the drawer and other sliding windows, other than sash windows. In an example the frame member 2 may comprise an elongate member extending along the frame member 2 and the sliding mechanism is located within the elongate member. The elongate member may be an extrusion and may be made from a metal, composite or plastic material, for example the extrusion may be made from aluminium, steel, stainless steel, and/or extruded plastic.

In an example the closure element is rotationally fixed relative to the frame. In this example the closure element is rotationally fixed and does not comprise a shoot bolt 10 to inhibit rotation of the closure element relative to the frame. In this example the longitudinally extending recess 6 may be covered above the closure element. In an example the cover may comprise a blanking plate attachable to the longitudinally extending recess 6. The blanking plate may be attachable to the longitudinally extending recess 6 with an interference fit and/or a coupling mechanism. In this example the longitudinally extending recess 6 below the closure element will be open to allow the connecting member 8 and the closure element to move relative to the frame.

Embodiments of the invention may include any of the described features, including any combination of a sliding mechanism, a coupling member to inhibit the closure element to slide relative to the frame, a bolt mechanism, a locking mechanism, a spring, a cord to arrest the rotation of the closure element.

It should also be appreciated that particular combinations of the various features described and defined in any aspects of the invention can be implemented and/or supplied and/or used independently. Other examples and variations will be apparent to the skilled addressee in the context of the present disclosure.

In an embodiment the frame comprises a plurality of elongate frame members defining a frame opening for receiving a closure element for closing the frame opening; at least one of the elongate frame members having a longitudinally extending recess; a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is arranged to be coupled to the closure element when the closure element is received within the frame opening to enable the closure element to slide relative to the frame. The frame may be a window frame and the closure element may be a window. The second track may be coupled to the closure element by at least one connecting member defining a pivot about which the closure element can rotate relative to the frame, and the frame may further comprise a cord attachable to the closure element to enable the rotation of the closure element about the pivot to be arrested. The cord may further comprise a cord reel, the cord being arranged to be extended or retracted by the cord reel as the closure element moves about the pivot point. The frame may further comprise a bolt mechanism to inhibit rotation the closure element about the pivot. The bolt mechanism may be a bolt connectable to the closure element to inhibit rotation of the closure element about the pivot. The bolt mechanism may comprise a shoot bolt mechanism. The bolt mechanism may be arranged to activate a locking mechanism to inhibit movement of the second track relative to the first track. The locking mechanism may comprise a spring biased to a locked condition, wherein the bolt mechanism is arranged to hold the locking mechanism in an unlocked condition against the biasing of the spring biased such that when the bolt mechanism is disengaged to enable rotation of the closure element about the pivot, the locking mechanism is in the locked condition inhibiting movement of the second track relative to the first track. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member may be a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track. The first and second tracks may be racks comprising a plurality of teeth and the rotary coupling member is a pinion comprising a plurality of teeth and wherein the locking mechanism comprises teeth which lock with at least one of the second rack and the pinion when in the locked position. The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks may comprise a tooth free area in which the rotary coupling member is not engaged with the racks. The frame may further comprise a spring coupled to the second track and the frame wherein the spring is arranged to modulate the force required to move the second track relative to the first track. The spring may be a gas spring and the gas spring may be pressurised to a pressure to adjust the resistance to motion of the second track. The frame assembly may comprise a frame with at least one said closure element.

In an embodiment the window assembly comprises a frame and at least one window received within the frame, the frame comprising a plurality of elongate frame members defining a frame opening receiving the at least one window for closing the frame opening; at least one of the elongate frame members having a longitudinally extending recess; a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is coupled to the window or one of the windows by a coupling mechanism carried by at least one of the track and that window to enable that window to slide relative to the frame. The coupling mechanism may comprise cooperating projections and recesses carried by the window and second track. The second track may be coupled to the at least one window by at least one connecting member defining a pivot about which the at least one window can rotate relative to the frame. The window assembly may further comprise a cord attachable to the at least one window to enable the rotation of the at least one window about the pivot to be arrested. The cord may further comprise a cord reel, the cord being arranged to be extended or retracted by the cord reel as the at least one window moves about the pivot point. The window assembly may further comprise a bolt mechanism to inhibit rotation the closure element about the pivot. The bolt mechanism may be a bolt connectable to the closure element to inhibit rotation of the closure element about the pivot. The bolt may comprise a shoot bolt mechanism. The bolt may be arranged to activate a locking mechanism to inhibit movement of the second track relative to the first track. The locking mechanism may comprise a spring biased to a locked condition, wherein the bolt is arranged to hold the locking mechanism in an unlocked condition against the biasing of the spring biased such that when the bolt is disengaged to enable rotation of the at least one window about the pivot, the locking mechanism is in the locked condition inhibiting movement of the second track relative to the first track. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member is a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track. The first and second tracks may be racks comprising a plurality of teeth and the rotary coupling member is a pinion comprising a plurality of teeth and wherein the locking mechanism comprises teeth which lock with at least one of the second rack and the pinion when in the locked position. The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks may comprise a tooth free area in which the rotary coupling member is not engaged with the racks. The window assembly according may further comprise a spring coupled to the second track and the frame wherein the spring is arranged to modulate the force required to move the second track relative to the first track. The spring may be a gas spring and the gas spring may be pressurised to a pressure to adjust the resistance to motion of the second track. The window assembly may comprise at least one said closure element.

In an embodiment the frame comprising a plurality of elongate frame members defining a frame opening for receiving a closure element for closing the frame opening; a slide mechanism, wherein the slide mechanism comprises a first track fixed to one of the elongate frame members and a second track movable longitudinally of the elongate frame member and coupled to the first track via a rotary coupling member such that movement of second track along the recess causes the rotary coupling member to rotate, wherein the second track is arranged to be coupled to the closure element when the closure element is received within the frame opening to enable the closure element to slide relative to the frame, wherein the second track is coupled to the closure element by at least one connecting member defining a pivot about which the closure element can rotate relative to the frame and a cord is attached to the closure element to enable the rotation of the closure element about the pivot to be arrested. The cord may further comprise a cord reel, the cord being arranged to be extended or retracted by the cord reel as the closure element moves about the pivot point. The frame may further comprise a bolt mechanism to inhibit rotation the closure element about the pivot. The bolt mechanism may be a bolt connectable to the closure element to inhibit rotation of the closure element about the pivot. The bolt may comprise a shoot bolt mechanism. The bolt may be arranged to activate a locking mechanism to inhibit movement of the second track relative to the first track. The locking mechanism may comprise a spring biased to a locked condition, wherein the bolt is arranged to hold the locking mechanism in an unlocked condition against the biasing of the spring biased such that when the bolt is disengaged to enable rotation of the closure element about the pivot, the locking mechanism is in the locked condition inhibiting movement of the second track relative to the first track. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member is a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track. The first and second tracks may be racks comprising a plurality of teeth and the rotary coupling member is a pinion comprising a plurality of teeth and wherein the locking mechanism comprises teeth which lock with at least one of the second rack and the pinion when in the locked position. The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks comprises a tooth free area in which the rotary coupling member is not engaged with the racks. The frame may comprise a spring coupled to the second track and the frame wherein the spring is arranged to modulate the force required to move the second track relative to the first track. The spring may be a gas spring. The gas spring may be pressurised to a pressure to adjust the resistance to motion of the second track. The frame assembly may comprise a frame according with at least one said closure element.

In an embodiment a frame comprising a plurality of elongate frame members defining a frame opening for receiving a closure element for closing the frame opening; at least one of the elongate frame members having a longitudinally extending recess; a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is arranged to be coupled to the closure element by at least one connecting member when the closure element is received within the frame opening to enable the closure element to slide relative to the frame, wherein the connecting member defines a pivot about which the closure element can rotate relative to the frame; and a bolt mechanism to inhibit rotation of the closure element about the pivot. The bolt mechanism may be a bolt connectable to the closure element to inhibit rotation of the closure element about the pivot. The bolt mechanism may comprise a shoot bolt mechanism. The bolt mechanism may be arranged to activate a locking mechanism to inhibit movement of the second track relative to the first track. The frame may be a window frame and the closure element is a window. The frame may further comprise a cord attachable to the closure element to enable the rotation of the closure element about the pivot to be arrested. The cord may comprise a cord reel, the cord being arranged to be extended or retracted by the cord reel as the closure element moves about the pivot point. The locking mechanism may comprise a spring biased to a locked condition, wherein the bolt mechanism is arranged to hold the locking mechanism in an unlocked condition against the biasing of the spring biased such that when the bolt mechanism is disengaged to enable rotation of the closure element about the pivot, the locking mechanism is in the locked condition inhibiting movement of the second track relative to the first track. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member is a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track. The first and second tracks may be racks comprising a plurality of teeth and the rotary coupling member is a pinion comprising a plurality of teeth and wherein the locking mechanism comprises teeth which lock with at least one of the second rack and the pinion when in the locked position. The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks may comprise a tooth free area in which the rotary coupling member is not engaged with the racks. The frame may further comprise a spring coupled to the second track and the frame wherein the spring is arranged to modulate the force required to move the second track relative to the first track. The spring may be a gas spring. The gas spring may be pressurised to a pressure to adjust the resistance to motion of the second track. The frame assembly may comprise a frame with at least one said closure element.

In an embodiment a frame comprises a plurality of elongate frame members defining a frame opening for receiving a closure element for closing the frame opening; at least one of the elongate frame members having a longitudinally extending recess; a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is arranged to be coupled to the closure element by at least one connecting member when the closure element is received within the frame opening to enable the closure element to slide relative to the frame; wherein the connecting member defines a pivot about which the closure element can rotate relative to the frame; a bolt to inhibit rotation of the closure element about the pivot, wherein the bolt is arranged to activate a locking mechanism to inhibit movement of the second track relative to the first track. The locking mechanism may comprise a spring biased to a locked condition, wherein the bolt is arranged to hold the locking mechanism in an unlocked condition against the biasing of the spring biased such that when the bolt is disengaged to enable rotation of the closure element about the pivot, the locking mechanism is in the locked condition inhibiting movement of the second track relative to the first track. The bolt may comprise a shoot bolt mechanism. The frame may be a window frame and the closure element is a window. The frame may further comprise a cord attachable to the closure element to enable the rotation of the closure element about the pivot to be arrested. The cord may further comprise a cord reel, the cord being arranged to be extended or retracted by the cord reel as the closure element moves about the pivot point. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member is a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track.

The first and second tracks may be racks comprising a plurality of teeth and the rotary coupling member is a pinion comprising a plurality of teeth and wherein the locking mechanism comprises teeth which lock with at least one of the second rack and the pinion when in the locked position The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks may comprise a tooth free area in which the rotary coupling member is not engaged with the racks. The frame may further comprising a spring coupled to the second track and the frame wherein the spring is arranged to modulate the force required to move the second track relative to the first track. The spring may be a gas spring. The gas spring may be pressurised to a pressure to adjust the resistance to motion of the second track. The frame may further comprise at least one said closure element.

In an embodiment a frame comprises a plurality of elongate frame members defining a frame opening for receiving a closure element for closing the frame opening; at least one of the elongate frame members having a longitudinally extending recess; a slide mechanism received within the recess, wherein the slide mechanism comprises a first track fixed within the recess and a second track movable within and along the recess and coupled to the first track via a rotary coupling member such that movement of second track along the recess causes the rotary coupling member to rotate, wherein the second track is arranged to be coupled to the closure element when the closure element is received within the frame, opening to enable the closure element to slide relative to the frame; and a spring coupled to the second track and the frame wherein the spring is arranged to modulate the force required to move the second track relative to the first track. The spring may be a gas spring. The gas spring may be pressurised to a pressure to adjust the resistance to motion of the second track.

The frame may be a window frame and the closure element is a window. The second track may be coupled to the closure element by at least one connecting member defining a pivot about which the closure element can rotate relative to the frame. The frame may further comprise a cord attachable to the closure element to enable the rotation of the closure element about the pivot to be arrested. The cord may further comprises a cord reel, the cord being arranged to be extended or retracted by the cord reel as the closure element moves about the pivot point. The frame may further comprise a bolt mechanism to inhibit rotation the closure element about the pivot. The bolt mechanism may be a bolt connectable to the closure element to inhibit rotation of the closure element about the pivot. The bolt mechanism may comprise a shoot bolt mechanism. The bolt mechanism may be arranged to activate a locking mechanism to inhibit movement of the second track relative to the first track. The locking mechanism may comprise a spring biased to a locked condition, wherein the bolt mechanism is arranged to hold the locking mechanism in an unlocked condition against the biasing of the spring biased such that when the bolt mechanism is disengaged to enable rotation of the closure element about the pivot, the locking mechanism is in the locked condition inhibiting movement of the second track relative to the first track. The rotary coupling member may comprise a first rotary coupling element coupled with the first track and a second rotary coupling element coupled with the second track, with the first rotary coupling element having a different diameter to the second rotary coupling element such that upon rotation of the rotary coupling member the second rotary coupling element moves a different distance along the second track than the first coupling element moves along the first track. The first and second tracks may be racks comprising a plurality of teeth and the rotary coupling member is a pinion comprising a plurality of teeth. The first and second tracks may be racks each comprising a plurality of teeth and wherein the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track. The first and second tracks may be racks comprising a plurality of teeth and the rotary coupling member is a pinion comprising a plurality of teeth and wherein the locking mechanism comprises teeth which lock with at least one of the second rack and the pinion when in the locked position The first and second tracks may be racks comprising a plurality of teeth, the rotary coupling member comprises a first toothed pinion coupled with the first track and a second toothed pinion coupled with the second track, with the first and second pinions having different numbers teeth such that upon rotation of the rotary coupling member the second pinion moves a different distance along the second track than the first pinion moves along the first track, and wherein the locking mechanism comprises teeth which lock with at least one of the second rack and first and second pinions. At least one of the first or second tracks may comprise a freewheeling area in which the rotary coupling member is not engaged with the tracks. At least one of the first or second racks may comprise a tooth free area in which the rotary coupling member is not engaged with the racks. The frame assembly may comprise a frame according with at least one said closure element. The frame may further comprise a coupling member connectable to the frame and closure element to inhibit the closure element to slide relative to the frame. The window assembly may further comprise a coupling member connectable to the frame and closure element to inhibit the closure element to slide relative to the frame. The bolt mechanism may inhibit the closure element to slide relative to the frame. The bolt mechanism may inhibit the closure element to slide relative to the frame.

What is claimed is:

1. A window frame comprising a plurality of elongate frame members defining a frame opening for receiving a window for closing the frame opening;

at least one of the elongate frame members having a longitudinally extending recess; and a slide mechanism received within the recess, wherein the slide mechanism comprises a first track fixed within the recess and a second track movable within and along the recess and coupled to the first track via a rotary coupling member such that movement of the second track along the recess causes the rotary coupling member to rotate, wherein the second track is arranged to be coupled to the window when the window is received within the frame opening to enable the window to slide relative to the frame;

wherein the rotary coupling member comprises a first rotary coupling element coupled with the first track and a second rotary coupling element coupled with the second track, wherein the first rotary coupling element has a different diameter to the second rotary coupling element and the first rotary coupling element and the second rotary coupling element are arranged such that, upon rotation of the rotary coupling member, the second track moves a different distance relative to the rotary coupling member than the first track moves relative to the rotary coupling member.

2. A frame according to claim 1, wherein the first rotary coupling element and the second rotary coupling element are arranged to provide gearing.

3. A frame according to claim 1, wherein the rotary coupling member is arranged so that rotation of the first rotary coupling element causes rotation of the second rotary coupling element.

4. A frame according to claim 1 wherein the first track and the second track each comprise racks comprising a plurality of teeth and the first rotary coupling element comprises a first toothed pinion comprising a plurality of teeth and the second rotary coupling element comprises a second toothed pinion comprising a plurality of teeth.

5. A frame according to claim 4, wherein the first pinion has a different number of teeth than the second pinion such that upon rotation of the rotary coupling member the second pinion moves a different distance along the second track than the first pinion moves along the first track.

6. A frame according to claim 4, wherein at least one of the first or second racks comprises a tooth free area configured to enable at least one of (i) the first toothed pinion and (ii) the second toothed pinion to disengage from the racks.

7. A frame according to claim 1 in which the window is received within the frame.

8. A kit of parts for the window frame according to claim 1.

9. A window frame comprising a plurality of elongate frame members defining a frame opening for receiving a window for closing the frame opening;

at least one of the elongate frame members having a longitudinally extending recess; and a slide mechanism received within the recess, wherein the slide mechanism comprises a first track fixed within the recess and a second track movable within and along the recess and coupled to the first track via a rotary coupling member such that movement of the second track along the recess causes the rotary coupling member to rotate, wherein the second track is arranged to be coupled to the window when the window is received within the frame opening to enable the window to slide relative to the frame;

wherein at least one of the first or second tracks comprises a freewheeling area configured to enable the rotary coupling member to disengage from the tracks.

10. A window frame comprising a plurality of elongate frame members defining a frame opening for receiving a window for closing the frame opening;

at least one of the elongate frame members having a longitudinally extending recess; and a slide mechanism received within the recess, wherein the slide mechanism comprises a first track fixed within the recess and a second track movable within and along the recess and coupled to the first track via a rotary coupling member such that movement of the second track along the recess causes the rotary coupling member to rotate, wherein the second track is arranged to be coupled to the window when the window is received within the frame opening to enable the window to slide relative to the frame;

wherein the second track is coupled to the window by at least one connecting member defining a pivot about which the window can rotate relative to the frame, and a bolt mechanism to inhibit rotation the window about the pivot.

11. A frame according to claim 10, wherein the bolt mechanism comprises a bolt connectable to the window to inhibit rotation of the window about the pivot.

12. A frame according to claim 11 wherein the bolt mechanism is arranged to activate a locking mechanism to inhibit movement of the second track relative to the first track, wherein the locking mechanism is arranged to lock with teeth carried by at least one of the rotary coupling member and the second rack.

13. A frame according to claim 12, wherein the locking mechanism comprises a spring biased to a locked condition, wherein the bolt mechanism is arranged to hold the locking mechanism in an unlocked condition against the biasing of the spring.

14. The frame of claim 13 wherein the locking mechanism is biased such that, when the bolt mechanism is disengaged to enable rotation of the window about the pivot, the locking mechanism is in the locked condition inhibiting movement of the second track relative to the first track.

15. A frame according to claim 10 further comprising a cord attachable to the window to enable the rotation of the window about the pivot to be arrested.

16. A frame according to claim 10, wherein the cord further comprises a cord reel, the cord being arranged to be extended or retracted by the cord reel as the window moves about the pivot point.

17. A window frame comprising a plurality of elongate frame members defining a frame opening for receiving a window for closing the frame opening;

at least one of the elongate frame members having a longitudinally extending recess; and a slide mechanism received within the recess, wherein the slide mechanism comprises a first track fixed within the recess and a second track movable within and along the recess and coupled to the first track via a rotary coupling member such that movement of the second track along the recess causes the rotary coupling member to rotate, wherein the second track is arranged to be coupled to the window when the window is received within the frame opening to enable the window to slide relative to the frame;

wherein the window is coupleable to the second track via a pulley to enable the sliding mechanism to operate as a replacement for a conventional sash counterweight.

18. A window frame comprising a plurality of elongate frame members defining a frame opening for receiving a window for closing the frame opening;

at least one of the elongate frame members having a longitudinally extending recess;

a slide mechanism received within the recess, wherein the slide mechanism comprises a first track fixed within the recess and a second track movable within and along the recess and coupled to the first track via a rotary coupling member such that movement of the second track along the recess causes the rotary coupling member to rotate, wherein the second track is arranged to be coupled to the window when the window is received within the frame opening to enable the window to slide relative to the frame; and a spring coupled to the second track and the frame wherein the spring is arranged to modulate the force required to move the second track relative to the first track.

19. A frame according to claim 18, wherein the spring comprises a gas spring that can be adjustably pressurised to adjust the resistance to motion of the second track.

* * * * *